United States Patent [19]

Munz

[11] Patent Number: 5,007,797

[45] Date of Patent: Apr. 16, 1991

[54] HOLD-BACK DEVICE FOR SELECTIVELY SEPARATING SHEETS FED SERIATEM TO A STACK

[75] Inventor: Rolf Munz, Kernen, Fed. Rep. of Germany

[73] Assignee: Eastman Kodak Company, Rochester, N.Y.

[21] Appl. No.: 437,006

[22] Filed: Nov. 15, 1989

[30] Foreign Application Priority Data

Nov. 21, 1988 [DE] Fed. Rep. of Germany ..... 3839305

[51] Int. Cl.[5] ..... B65G 57/00; B65H 31/32

[52] U.S. Cl. ..... 414/790.8; 271/213; 271/292

[58] Field of Search ..... 271/207, 213, 220, 221, 271/280, 290, 292; 270/52, 53, 58; 414/789.9, 790.8

[56] References Cited

U.S. PATENT DOCUMENTS

| | | | |
|---|---|---|---|
| 2,414,059 | 1/1947 | Powers | 414/790.8 X |
| 4,514,128 | 4/1985 | Hedrick | 414/790.8 X |
| 4,541,763 | 9/1985 | Chandhoke et al. | 414/790.8 X |
| 4,721,229 | 1/1988 | Dempf et al. | 271/213 X |

FOREIGN PATENT DOCUMENTS

| | | | |
|---|---|---|---|
| 8002831 | 12/1980 | United Kingdom | 414/790.8 |

*Primary Examiner*—Robert P. Olszewski
*Assistant Examiner*—Tuan N. Nguyen
*Attorney, Agent, or Firm*—Lawrence P. Kessler

[57] ABSTRACT

A collecting bin for stacking sheets fed seriatem thereto, including an abutment associated with the front edges of the sheets in the area where a stapling device and a sheet-stack removal device are arranged. Above a sheet stack in the collecting bin and upstream of the stapling device, a rotatable shaft is mounted transversely to the sheet-feeding direction and parallel with the upper side of the sheet stack. The shaft is driven by a stepping motor in either direction of rotation. Separating fingers, arranged on the shaft, are selectively lowered onto the sheet stack by shaft rotation to form an inclined feeding surface for subsequently entering sheets, separating such subsequently fed sheets from the sheet stack beneath. When the sheet stack has been removed from the collecting bin, the shaft rotates in the opposite direction in order for separating fingers to deposit the separated sheets in the collecting bin. After the sheets have been deposited, the rotation of the shaft moves the separating fingers until they assume an initial position above the sheet stack.

3 Claims, 1 Drawing Sheet

HOLD-BACK DEVICE FOR SELECTIVELY SEPARATING SHEETS FED SERIATEM TO A STACK

BACKGROUND OF THE INVENTION

This invention relates to apparatus for stacking sheets fed seriatem to a collecting bin where they are collected one on top of the other in a stack, the apparatus comprising a hold-back device which is arranged above the stack of sheets and in the area of the front edges of the stacked sheets and can be selectively introduced between the complete sheet stack and sheets subsequently fed to the stack.

In a sheet stacking apparatus disclosed in DE-PS No. 25 25 422, the sheets transported to a stacking point can temporarily be held back by a trapping device such that the sheet stack located underneath can be removed. For this purpose the trapping device comprises tongues which can be operated electromagnetically, each of which is associated with an electromagnet, which requires a great amount of components and a complex control in addition to a considerable amount of space.

SUMMARY OF THE INVENTION

It is an object of this invention to provide a sheet stacking apparatus where free access to further processing units is provided in the area in which a hold-back device is arranged.

According to the invention, this object is attained by a hold-back device which comprises at least one rotatably mounted separating finger which is driven by a reversible motor. The separating finger, directed in opposition to the direction of sheet transport, is rotatable both in the direction of sheet transport and in the opposite direction.

Advantageously the hold-back device is designed such that at least two flexible separating fingers are mounted on a shaft which is arranged transversely to the direction of sheet transport and parallel with the upper side of the sheet stack.

Due to this simplified hold-back device, which is driven by a stepping motor arranged adjacent to the collecting bin and whose separating finger consists of simple parts bent from spring steel, a considerable amount of space is made available which can be used for arranging further processing units such as a stapling and/or gripping device. Moreover the number of components and the complexity of control are minimized.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
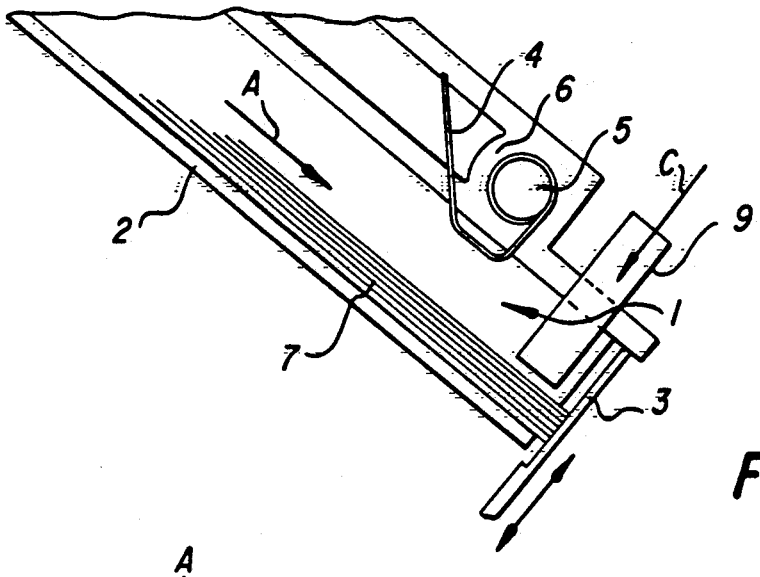
FIG. 1 is a partial lateral sectional view of a sheet stacking apparatus with the hold-back device according to this invention in its inoperative position.

Referring now to the accompanying drawings, a sheet stacking apparatus comprises a collecting bin 1 which is arranged on a further processing unit, not illustrated in detail, for stapling and/or stacking copy sheets. The further processing unit is directly connected, for example, to any commercially available reproduction apparatus (not illustrated) whose copy sheets are delivered seriatem and are introduced into the processing unit, where they are fed into the collecting bin 1 in the direction of the arrow "A". Collecting bin 1 is downwardly inclined in the sheet-feed direction "A" and comprises at its lower end, and electromagnetically operated abutment 3. The sheets fed into collecting bin 1 in the direction of the arrow "A" are stacked on a support 2 of the collecting bin 1 and aligned at their lead ends against the abutment 3. In the area of the lead end of sheet stack 7, a stapling device 9 (not illustrated in detail) is arranged which forms a complete stack of copy sheets by stapling.

Figure 2:
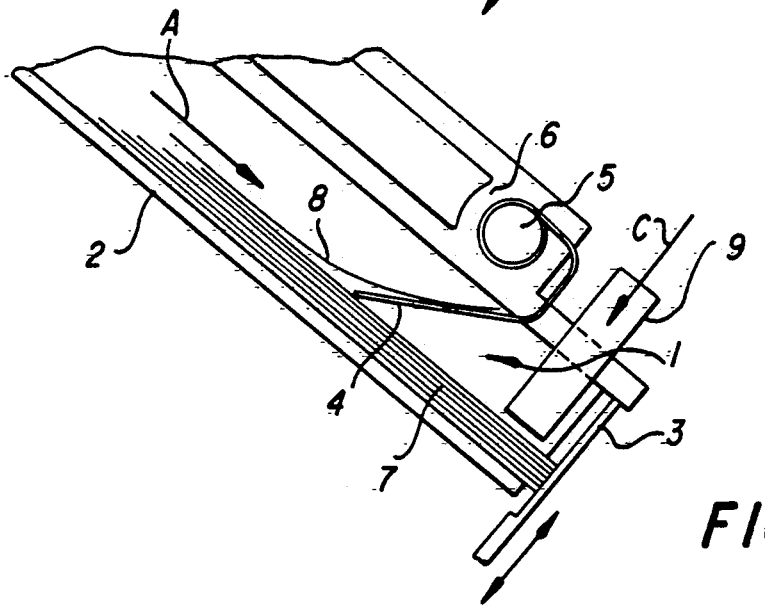
FIG. 2 is similar to FIG. 1 with the hold-back device in its lowered position.

Above sheet stack 7 and upstream of stapling device 9, a shaft 5 extending transversely to the sheet-feeding direction "A" and parallel with the upper side of sheet stack 7 is mounted for rotation about a journal 6. Shaft 5 is driven, in a manner to be described further below, by a stepping motor (not illustrated) which is mounted outside collecting bin 1. A hold-back device, such as two spaced separating fingers 4 are mounted on shaft 5. The separating fingers 4 are made from spring steel and are shaped and arranged such that when they are in their lowered position, as shown in FIG. 2, they rest on sheet stack 7 and form an inclined feeding surface for subsequently entering copy sheets 8. The separating fingers 4 are arranged on shaft 5 such that they can rotate past the stapling device 9. The stapling device 9 may comprise one or several stapling heads arranged in a line.

The apparatus functions as follows:

The copy sheets arriving seriatem at the collecting bin 1 in the sheet-feeding direction "A" move up to the abutment 3 where they are aligned and stacked one above the other on support 2. During this stacking operation the separating fingers 4 are in an upward position outside the collecting bin 1, as can be seen from FIG. 1. As soon as the intended number of copy sheets has been stacked in collecting bin 1 (in response to a counting device not illustrated), the separating fingers 4 are lowered onto the upper side of the stack. This is brought about by a reversible stepping motor which selectively rotates shaft 5 counterclockwise through a corresponding angle until the separating fingers 4 are arranged in a sheet-feeding path so as to rest on the upper side of the stack (see FIG. 2).

The next copy sheet 8 entering the collecting bin 1 is thus separated from sheet stack 7 lying underneath and moves up the inclined feeding path of the separating fingers 4 to be arrested after the rear edge of copy sheet 8 has fallen into place in collecting bin 1. Each of the following copy sheets, which are all fed seriatem into collecting bin 1 from the upper side of sheet stack 7, is then caught in the same manner by the copy sheet 8 already deflected by the separating fingers 4. Meanwhile, the sheet stack 7 with its predetermined number of collected copy sheets is stapled by the stapling device 9. As soon as the stapling operation has been completed, the separating fingers 4 are lifted, thus lifting the separated sheets 8 (see FIG. 3). The stapled sheet stack 7 can then be removed without difficulty. This lifting of the separating fingers 4 is once again brought about by the stepping motor which, for this purpose, rotates shaft 5 clockwise until the separating fingers 4 assume the intermediate position shown in FIG. 3 in which subsequent copy sheets are deflected in the direction of the arrow "B".

When the sheets have been stapled, abutment 3 is shifted downwardly so that the stapled sheet stack 7 can be removed. The stack is preferably removed by a gripping device of any known type (not illustrated) which operates in the direction of the arrow "D". The gripping device delivers the stapled sheet stacks 7 from the collecting bin 1 to a further processing unit. After the stapled sheet stack has been removed from collecting bin 1, abutment 3 is moved upwardly into its closing position.

Figure 3:
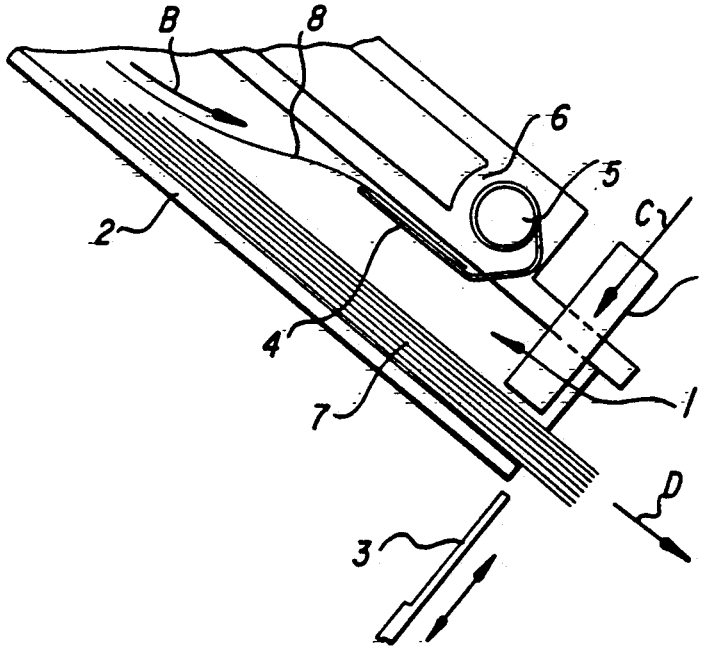
FIG. 3 is similar to FIG. 1 with the hold-back device in its lifted position.

Subsequently, the stepping motor rotates shaft 5 counterclockwise, as a result of which the separating fingers 4 are pivoted counterclockwise from their position illustrated in FIG. 3 to deposit the copy sheets 8 located on the separating fingers 4 on the support 2 of collecting bin 1, which is now empty. The separating fingers 4 continue their pivotal movement in the same direction in front of the copy sheets until they have assumed their initial position illustrated in FIG. 1. The subsequent copy sheets are aligned and stacked on support 2 against abutment 3 in the same manner as described above until the predetermined number of copies has been collected and the separating fingers 4 are lowered, as described above, for temporarily interrupting the stacking operation.

Due to the arrangement and control of the separating fingers 4 the stacking and stapling of the copy sheets and the removal of the stapled sheet stacks can be carried out without interruption or any delay in the supply of the copy sheets entering the collecting bin 1. This also applies if the individual copy stacks are not stapled after collecting but are removed from the collecting bin 1 by means of a gripping device. In contrast to the illustrated embodiment, the collecting bin 1 may also be either inclined by a smaller angle or horizontally arranged, without the operation of the separating fingers 4 being changed thereby.

The invention has been described in detail with particular reference to a preferred embodiment thereof, but it will be understood that variations and modifications can be effected within the spirit and scope of the invention as described hereinabove and a defined in the appended claims.

I claim:

1. Apparatus for stacking sheets fed seriatem to a collecting bin where they are collected one on top of the other in a stack, said apparatus comprising:

a hold-back device which is arranged above the stack of sheets and in the area of the leading edges of said stacked sheets and can be temporarily introduced between the complete stack of sheets and sheets subsequently fed to said stack, said hold-back device including at least one rotatably mounted flexible separating finger which is driven by a motor and is directed in opposition to the direction of sheet transport and rotatable both in the direction of sheet transport and in the opposite direction, the separating finger being rotatable when temporarily introduced between the complete stack of sheets and sheets subsequently fed to said stack into a position in which it rests on the sheet stack and forms an inclined feeding surface for subsequently arriving sheets.

2. Apparatus according to claim 1 wherein the separating finger is attached to a shaft which is arranged transversely to the direction of sheet transport and parallel with the upper side of the sheet stack.

3. Apparatus according to claim 2 wherein the separating finger carries out a rotary movement in the direction of sheet transport for releasing the sheets held back, said movement terminating in an initial position above the sheet stack.

* * * * *